US006684411B1

(12) United States Patent
Bachert et al.

(10) Patent No.: US 6,684,411 B1
(45) Date of Patent: Feb. 3, 2004

(54) MEDICAL SOCK

(76) Inventors: Edward Bachert, 116 Valley St., New Philadelphia, PA (US) 17959; Mildred Bachert, 116 Valley St., New Philadelphia, PA (US) 17959

( * ) Notice: Subject to any disclaimer, the term of this patent is extended or adjusted under 35 U.S.C. 154(b) by 0 days.

(21) Appl. No.: 10/225,107

(22) Filed: Aug. 20, 2002

Related U.S. Application Data

(60) Provisional application No. 60/314,946, filed on Aug. 27, 2001.

(51) Int. Cl.[7] ..... A43B 17/00
(52) U.S. Cl. ..... 2/239
(58) Field of Search ..... 2/239, 240, 241, 2/242, 409, 267, DIG. 3; 66/178 R; 36/29; 442/96; 239/34

(56) References Cited

U.S. PATENT DOCUMENTS

| | | | | | |
|---|---|---|---|---|---|
| 832,550 | A | * | 10/1906 | Lepper | 2/61 |
| 1,433,309 | A | * | 10/1922 | Stimpson | 36/8.1 |
| 1,436,439 | A | * | 11/1922 | Eichhorn | 128/894 |
| 1,805,035 | A | * | 5/1931 | Branley | 66/178 R |
| 2,248,303 | A | * | 7/1941 | Morgenroth et al. | 2/239 |
| 2,422,736 | A | * | 6/1947 | Lambert | 2/241 |
| 2,771,691 | A | * | 11/1956 | Luchs | 36/10 |
| 2,916,036 | A | | 12/1959 | Sutton | |
| 3,417,408 | A | * | 12/1968 | Caggiano | 2/239 |
| 3,882,868 | A | * | 5/1975 | Tundermann | 604/293 |
| 3,967,390 | A | * | 7/1976 | Anfruns | 36/94 |
| 4,069,515 | A | | 1/1978 | Swallow | |
| 4,261,061 | A | * | 4/1981 | McAlvage | 2/239 |
| 4,296,499 | A | * | 10/1981 | Patterson et al. | 2/239 |
| 4,651,354 | A | * | 3/1987 | Petrey | 2/239 |
| 5,329,640 | A | * | 7/1994 | Hourigan | 2/239 |
| 5,596,770 | A | * | 1/1997 | Kunesh | 2/239 |
| 5,617,745 | A | * | 4/1997 | Della Corte et al. | 66/178 A |
| 5,623,734 | A | * | 4/1997 | Pugliatti | 2/239 |
| 5,675,992 | A | * | 10/1997 | Wrightenberry | 66/178 R |
| 5,682,617 | A | * | 11/1997 | Tumas | 2/239 |
| 5,737,776 | A | * | 4/1998 | Jennings | 2/409 |
| 5,752,278 | A | * | 5/1998 | Gunn | 2/69 |
| 5,774,898 | A | * | 7/1998 | Malpee | 2/239 |
| 5,968,536 | A | | 10/1999 | Godfrey | |
| 6,117,119 | A | * | 9/2000 | Gould | 604/290 |
| 6,138,281 | A | * | 10/2000 | Chiaruttini | 2/239 |
| 6,247,182 | B1 | * | 6/2001 | Tasbas | 2/239 |
| 6,275,997 | B1 | * | 8/2001 | Richardson | 2/239 |
| 6,367,087 | B1 | * | 4/2002 | Spillman et al. | 2/239 |
| 6,378,139 | B1 | * | 4/2002 | Mazzaglia | 2/242 |
| 6,385,779 | B2 | * | 5/2002 | Boersema | 2/239 |
| 6,446,267 | B1 | * | 9/2002 | Shah | 2/239 |

* cited by examiner

*Primary Examiner*—John J. Calvert
*Assistant Examiner*—Alissa L. Hoey
(74) *Attorney, Agent, or Firm*—Matthew J. Peirce

(57) ABSTRACT

A medical apparatus is disclosed. The apparatus is a sock that would allow liquid lotion or medicine to be applied to a user's foot. The sock would have both a heel and a toe covering that would be capable of holding medicine within them and slowly releasing the medicine over a period of time.

3 Claims, 1 Drawing Sheet

MEDICAL SOCK

This application claims benefit of Provisional application No. 60/314,946 filed Aug. 27, 2001.

I. BACKGROUND OF THE INVENTION

The present invention concerns that of a new and improved medical apparatus.

II. DESCRIPTION OF THE PRIOR ART

U.S. Pat. No. 5,968,536, issued to Godfrey, discloses a device, such as a sock, comprised of synthetic rubber, with a medicine holder for use in applying a topical anesthetic to a patient's skin.

U.S. Pat. No. 4,069,515, issued to Swallow, discloses a non-slip article of footwear comprised of a thermoplastic material to increase friction.

U.S. Pat. No. 2,916,03, issued to Sutton, discloses a rubber glove with an interior layer of lanolin.

III. SUMMARY OF THE INVENTION

The present invention concerns that of a new and improved medical apparatus for applying medicine. The apparatus is a sock that would allow liquid lotion or medicine to be applied to a user's foot. The sock would have both a heel and a toe covering that would be capable of holding medicine within them and slowly releasing the medicine over a period of time.

There has thus been outlined, rather broadly, the more important features of a medical apparatus for applying medicine that the detailed description thereof that follows may be better understood and in order that the present contribution to the art may be better appreciated. There are, of course, additional features of the medical apparatus for applying medicine that will be described hereinafter and which will form the subject matter of the claims appended hereto.

In this respect, before explaining at least one embodiment of the medical apparatus for applying medicine in detail, it is to be understood that the medical apparatus for applying medicine is not limited in its application to the details of construction and to the arrangements of the components set forth in the following description or illustrated in the drawings. The medical apparatus for applying medicine is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present medical apparatus for applying medicine. It is important, therefore, that the claims be regarded as including such equivalent constructions insofar as they do not depart from the spirit and scope of the present invention.

It is therefore an object of the present invention to provide a medical apparatus for applying medicine which has all of the advantages of the prior art and none of the disadvantages.

It is another object of the present invention to provide a medical apparatus for applying medicine which may be easily and efficiently manufactured and marketed.

It is another object of the present invention to provide a medical apparatus for applying medicine which is of durable and reliable construction.

It is yet another object of the present invention to provide a medical apparatus for applying medicine which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Priority is hereby claimed to application Ser. No. 60/314,946, filed on Aug. 27, 2001.

Figure 1:
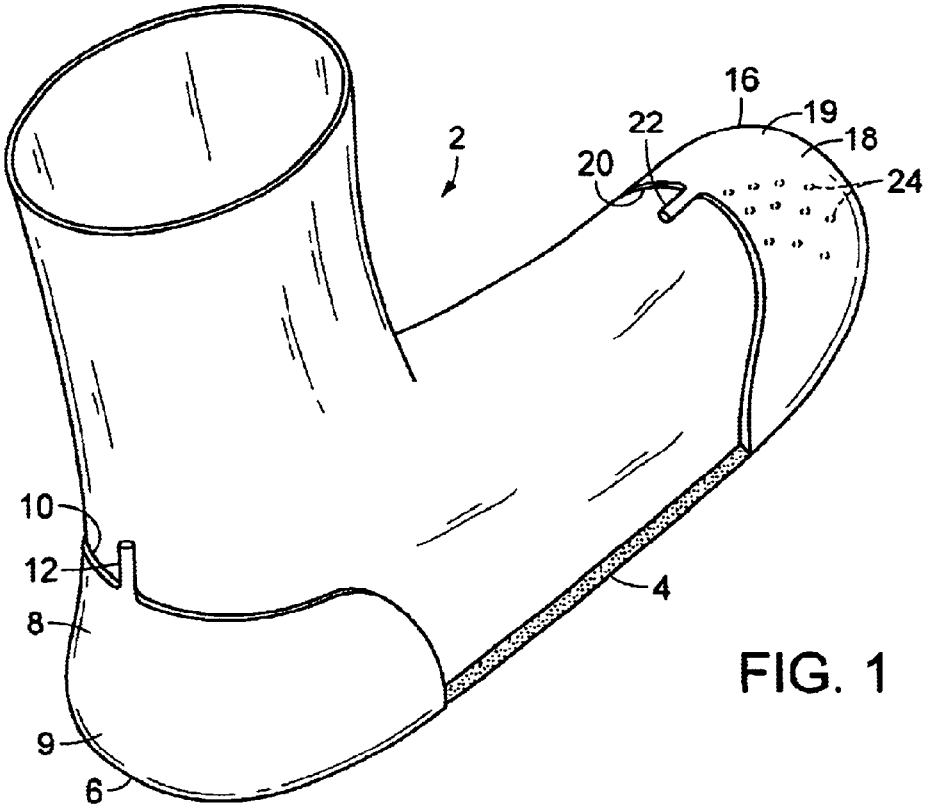
FIG. 1 shows a perspective view of the present invention.

FIG. 1 shows a perspective view of sock 2, which comprises the present invention. Sock 2 would preferably be a cotton sock that would be used for medicine application on a user's foot. Sock 2 would either be available in a single sock version within a pair of socks or both socks of a pair of socks could be designed to apply medicine to a user's feet.

Sock 2 would include skid-resistant bottom 4, which would be incorporated into the entire sole of each sock 2 of the present invention. Skid-resistant bottom 4 would be necessary because sock 2 would have liquid medicine incorporated into its very fabric, possibly causing sock 2 to become more slippery than a normal sock when worn.

Sock 2 would also include rubber heel 6, which would comprise outer portion 8 and inner portion 10. Outer portion 8 and inner portion 10 would be approximately circular in shape and would each have a perimeter, with the perimeter of outer portion 8 and inner portion 10 being approximately the same. The entire perimeter of outer portion 8 and inner portion 10 would be attached to one another, while the rest of the area of in between outer portion 8 and inner portion 10 would be a cavity 9 and designed for liquid medicine or lotion.

Sock 2 would have an injection nozzle 12 which would allow a user to inject liquid medicine or lotion into the cavity 9 between outer portion 8 and inner portion 10. Injection nozzle 12 would have two ends, a first end and a second end, with the first end of injection nozzle 12 being externally accessible and the second end of injection nozzle 12 being located within the cavity 9. Inner portion 10 would have a plurality of holes 14 to allow liquid medicine or lotion, once injected into the cavity 9 between outer portion 8 and inner portion 10, to slowly migrate into the fabric of the sock 2. The holes would be pin-sized or smaller to make sure that the liquid, whether it be lotion or medicine, would only gradually enter into the fabric of the sock. The mechanism that would cause the liquid lotion or medicine to enter into the fabric of the sock would be downward pressure from a user's foot, which would cause the liquid to be squeezed out of one or more holes into, the fabric of the user's sock.

Sock 2 would also include toe covering 16, which would comprise outer portion 18 and inner portion 20. Sock 2 would have injection nozzle 22 which would allow a user to inject liquid medicine or lotion into the cavity 19 between outer portion 18 and inner portion 20. Inner portion 20 would have a plurality of holes 24 to allow liquid medicine or lotion, once injected into the cavity between outer portion 18 and inner portion 20, to be injected into the fabric of the sock 2. Injection nozzle 22 would have two ends, a first end and a second end, with the first end of injection nozzle 22 being externally accessible and the second end of injection nozzle 22 being located within the cavity 19.

Outer portion 18 and inner portion 20 of toe covering 16 would function in the same way as outer portion 8 and inner portion 10 of sock 2, allowing liquid medicine or lotion to be gradually injected into a user's sock.

Figure 2:
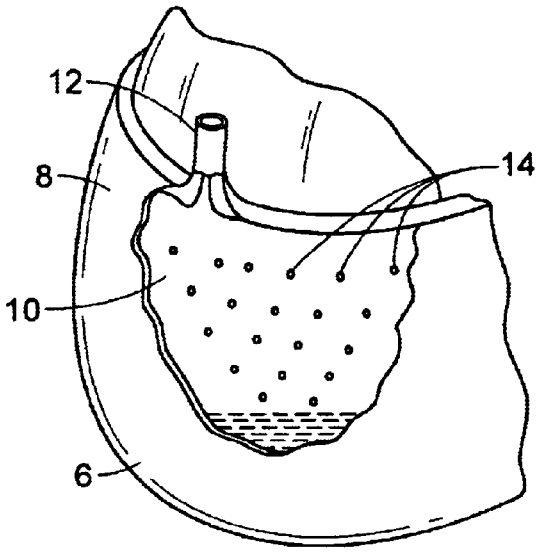
FIG. 2 shows a perspective close-up view of the heel of the present invention.

FIG. 2 shows a perspective close-up view of the heel 6 of the present invention, showing outer portion 8 and inner portion 10. In addition, injection nozzle 12, along with a plurality of holes 14, can be seen.

We claim:

1. A medical apparatus for applying liquid comprising:

(a) a sock, the sock having a heel portion, the sock further having a toe portion, the sock having two foot surfaces, a top foot surface and a bottom foot surface, (b) a skid-resistant surface attached to the bottom foot surface, (c) a rubber heel attached to the heel portion of the sock, the rubber heel comprising a pair of circular rubber pieces, an outer rubber piece and an inner rubber piece, the inner rubber piece being fixedly attached to the heel portion of the sock, the perimeter of the outer rubber piece fixedly attached to the perimeter of the inner rubber piece, the inner rubber piece having a plurality of holes evenly dispersed through its surface, (d) a first cavity located in between the inner rubber piece of the rubber heel and the outer rubber piece of the rubber heel, (e) a first injection nozzle having two ends, a first end and a second end, the first end of the first injection nozzle being inserted into the cavity, the second end of the first injection nozzle being accessible for injection of liquid, (f) a rubber toe segment attached to the toe portion of the sock, the rubber toe segment comprising a pair of circular rubber pieces, an outer rubber piece and an inner rubber piece, the inner rubber piece being fixedly attached to the toe portion of the sock, the perimeter of the outer rubber piece fixedly attached to the perimeter of the inner rubber piece, the inner rubber piece having a plurality of holes evenly dispersed through its surface, (g) a second cavity located in between the inner rubber piece of the rubber toe segment and the outer rubber piece of the rubber toe segment, (h) a second injection nozzle having two ends, a first end and a second end, the first end of the second injection nozzle being inserted into the second cavity, the second end of the second injection nozzle being accessible for injection of liquid, (i) wherein a user would be able to inject liquid into the pair of cavities through the first end of each of the injection nozzles, and further wherein the liquid would be dispersed onto an individual's foot through the plurality of holes in both the inner rubber piece of the rubber toe segment and the inner rubber piece of the rubber heel through downward pressure while the individual would be wearing the sock.

2. A medical apparatus for applying liquid according to claim 1 wherein the liquid injection into the pair of cavities would be lotion.

3. A medical apparatus for applying liquid according to claim 1 wherein the liquid injection into the pair of cavities would be medicine.

* * * * *